US005674656A

United States Patent [19]

Maniar

[11] Patent Number: 5,674,656

[45] Date of Patent: Oct. 7, 1997

[54] PROCESSES FOR STABILIZING DEVELOPER CHARGABILITY AND IMAGING PROCESSES THEREOF

[75] Inventor: Deepak R. Maniar, Penfield, N.Y.

[73] Assignee: Xerox Corporation, Stamford, Conn.

[21] Appl. No.: 587,093

[22] Filed: Jan. 16, 1996

[51] Int. Cl.[6] ..... G03G 9/097; G03G 13/08

[52] U.S. Cl. ..... 430/137; 430/120

[58] Field of Search ..... 430/120, 137

[56] References Cited

U.S. PATENT DOCUMENTS

| | | | |
|---|---|---|---|
| 4,614,165 | 9/1986 | Folkins et al. | 430/122 |
| 4,883,736 | 11/1989 | Hoffend et al. | 430/110 |
| 4,948,686 | 8/1990 | Koch et al. | 430/85 |
| 5,071,726 | 12/1991 | Maniar | 430/108 |
| 5,336,579 | 8/1994 | Zimmer et al. | 430/108 |

*Primary Examiner*—Roland Martin
*Attorney, Agent, or Firm*—John L. Haack

[57] ABSTRACT

A process for controlling $A_t$ transience comprising: providing in a developer housing, a two component developer composition comprising toner particles comprised of a resin, a pigment, a mixture of at least two charge additives, and unpreconditioned coated carrier core particles, wherein the developer is prepared by combining and thereafter blending a mixture of from 1 to about 10 parts by weight of toner particles with from about 100 parts by weight of carrier particles for about 10 minutes to about 30 minutes until an $A_t$ value of from about 60 to about 100 is attained; and forming and thereafter developing electrostatographic latent images on a photoconductive member in a two component development electrostatographic imaging apparatus with the developer composition; wherein the developer composition has an $A_t$ transient of less than about 20 relative units.

20 Claims, No Drawings

PROCESSES FOR STABILIZING DEVELOPER CHARGABILITY AND IMAGING PROCESSES THEREOF

CROSS REFERENCE TO COPENDING APPLICATIONS AND ISSUED PATENTS

Attention is directed to commonly owned and assigned U.S. Pat. No. 4,614,165, issued Sep. 30, 1986, entitled "EXTENDED LIFE DEVELOPMENT SYSTEM", wherein there is disclosed an apparatus which develops an electrostatic latent image recorded on a photoconductive member employed in an electrophotographic printing machine having a finite, usable life. The apparatus employs a developer material which ages during the life of the electrophotographic printing machine, and thus a continuous supply of carrier granules is furnished to the developer material. The addition of these carrier granules extends the useful life of the developer material so as to correspond to at least the useful life of the electrophotographic printing machine. U.S. Pat. No. 4,948,686, issued Aug. 14, 1990, entitled "PROCESS FOR FORMING TWO COLOR IMAGES", discloses a development process using a specific coated carrier with a coating weight of about 0.05 weight percent of the carrier core. U.S. Pat. No. 4,678,734, issued Jul. 7, 1987, to Laing et al., entitled "PROCESS FOR DEVELOPER COMPOSITION", discloses a process for making a developer composition comprising: 1) providing carrier particles having a core with a coating thereover; 2) introducing the carrier particles into a blending apparatus; 3) adding to the blending apparatus fine toner particles with a diameter of from about 2 to about 10 microns, these particles being comprised of toner resin particles, pigment particles, and a charge enhancing additive; 4) effecting blending for a period of time sufficient to enable the classified toner particles to alter the tribogenerating ability of the surface of the carrier particles and become embedded therein; 5) subsequently adding to the resulting blended mixture toner particles of a diameter of from about 2 to about 18 microns, and which particles are comprised of toner resin, pigment particles, and a charge enhancing additive; and 6) blending for a period of from about 1 minute to about 5 minutes.

Attention is directed to commonly owned and assigned copending applications Application Numbers, U.S. Ser. No. 08/145,118 (D/93570)filed Nov. 11, 1993, entitled "METHOD OF MAKING DEVELOPER WITH STABLE TRIBOELECTRIC CHARGING PROPERTIES", wherein there is disclosed a method of preparing a developer composition comprising: (1) blending carrier particles with finely divided toner particles, wherein blending is carried out for a period of time sufficient to enable the toner particles to alter the tribocharging ability of the carrier particles and become embedded therein; (2) dividing the blend of toner particles and carrier particles into coarse particles and fine particles; and (3) blending the coarse particles with toner particles.

The disclosures of the above mentioned patents and copending applications are incorporated herein by reference in their entirety.

BACKGROUND OF THE INVENTION

The present invention is generally directed to processes for the preparation of two component developer compositions and imaging processes thereof wherein the developer possesses long lived chargability and stable chargability properties. More specifically, the present invention relates to improved developer compositions for use in electrostatographic imaging processes, which provide, in embodiments, controlled developer chargability characteristics and improved developer imaging properties.

The present invention is also directed, in embodiments, to a process of preparing and using a lower charging, unoxidized, unpretreated, and spall or chunk free fluoropolymer coated developer that eliminates debris scums or films arising from the carrier coating from appearing on the photoreceptor, and $A_t$ or developer charge ability transience is effectively controlled, for example, in excess of about 800,000 developed copies.

Although the method disclosed in U.S. Pat. No. 4,678,734 produces a developer having relatively stable electrical properties, including consistent triboelectric charging values, acceptable charge distributions, and constant conductivity characteristics, it is also desirable to provide processes for using developers which not only provide stable electrical properties but also posses improved machine performance, particularly in the set up period or initial period of operation from a prior negative time ($t<0$) to a later time zero ($t=0$) after which period the development process is capable of providing images of acceptable copy quality.

Typically, after their introduction into a printing apparatus, developers prepared according to a number of known processes require approximately 2 or more hours of use or set up time before they produce prints having high copy quality, for example, good image sharpness and substantially no background deposits. Also, the aforementioned known developers and imaging processes generally require production of a high number of copies, for example, about 5,000 to about 20,000 copies, before high or superior quality copies are produced.

Generally, the process of electrophotographic printing includes charging a photoconductive member to a substantially uniform potential so as to sensitize the surface thereof. The charged portion of the photoconductive surface is exposed to a light image or digitally created facsimile of an original document being reproduced. This records an electrostatic latent image on the photoconductive member corresponding to the informational areas contained in the original document. After the electrostatic latent image is recorded on the photoconductive member, the latent image is developed by bringing a developer material into contact therewith. This forms a powder image on the photoconductive member which is subsequently transferred to a copy sheet. Finally, the powder image is heated to permanently fuse the image to the copy sheet in image configuration.

Generally, the developer material employed in an electrophotographic printing machine includes carrier granules having charged toner particles adhering triboelectrically thereto. The two component mixture is brought into contact with the photoconductive surface, and the charged toner particles are attracted from the carrier granules to opposite charges residing on the latent image. As the useful life of the developer material approaches an end, the quality of the copies being reproduced in printing machines can degrade. Machine service calls are severely impacted by the failure of the developer material not only from the perspective of developer material replacement, but also from an increased frequency of service calls for deteriorating copy quality reasons. These copy quality related calls may be caused by dirt generation arising from the developer material which is nearing the end of useful life. Therefore, the developer material is frequently changed without knowing the condition thereof to prevent the generation of dirt. Whereas, this can be wasteful of developer material, that is, when useful developer material is discarded, it might be presently economically justifiable to reduce or eliminate additional service calls, and where possible, to reduce the duration of or time consumed by the service call.

There are several properties of developer materials that change with age, for example, charging ability or in the alternative, chargability, conductivity, impurities, debris arising from degradation of toner particles, carrier particles and carrier coatings, and the like. The theory for holding only the charging ability, $A_t$, property constant is described hereinafter. It is believed that many or all the developer material properties will be affected and maintained in the same manner as that described with respect to the charging ability thereof. The charging ability of the developer material in a developer chamber can be expressed by the equation $$A_t = A_i + \{(A_d/(1+a/d)) - A_i\}\{1 - e^{-(a+d)(\text{No. copies})}\}$$

where $A_i$ is the initial charging ability of developer material in the chamber of the developer housing;

$A_d$ is the nominal charging ability of the carrier granules being discharged by a discharging unit into the chamber of the housing;

d is the dispensing rate of the carrier granules, that is, the fraction of the total carrier granules in the developer housing replaced per copy;

"a" is the natural aging rate of the developer material, that is, the fraction of developer material naturally aged per copy. The natural aging rate, a, is determined empirically;

"e" is the exponential term; and $A_t$ or "A sub t" is the developer charge ability. The steady state value for the charging ability may be expressed as:

$$A_t(\text{steady state}) = A\text{dispensing}/\{1+a/d\}$$

This latter equation describes saturation steady state results of dispensing carrier granules into the developer material in the chamber of the housing. For the carrier granule dispensing system to operate satisfactorily, this relationship is to provide a larger charging ability value than the minimum charging ability value of the developer material within an operating window boundary. It appears that the important parameter needed to determine whether this situation is achieved is the ratio of the natural aging rate to the rate of replacement of carrier granules. For any material with a given aging parameter, the dispense rate of the carrier granules must be adjusted to achieve a low enough ratio of aging to dispensing rate of the carrier granules.

The foregoing theory is correct if the natural aging of the carrier granules being supplied follows the following relationship:

$$A_t = A\text{dispensing } e^{(-a)(\text{No. copies})}$$

This relationship is generally followed. A developer dispensing formula can be derived for each natural aging relationship.

Developer material charging ability changes systematically with the age of the developer material and is believed to correspond approximately to an asymptotically logarithmic function over time. The developer material charging ability parameter, $A_t$ may also be considered to be the triboelectric charging ability of the developer material for any specified concentration of toner particles therein. For proper development of the electrostatic latent image, there is an operating latitude window for the chargability of the developer material. Typically, a developer material is chosen which has an initial charging ability roughly near the maximum allowable charging ability of the latitude window. As the developer material naturally ages, the charging ability of the developer material gradually decreases and falls beneath the latitude window lower boundary. At such time, the entire developer material within the chamber of the housing must be replaced with a new developer material. Thus, there is a life cycle and replacement schedule with conventional electrostatographic developers and development systems. However, when small amounts of carrier granules are added continuously as disclosed in the aforementioned commonly owned U.S. Pat. No. 4,614,165, the charging ability parameter($A_t$) of the developer material may not be reduced as quickly and the natural aging of the developer material and the time before failure, and hence, the replacement time interval will be significantly extended. If carrier granules are added to the developer material at some rate which is not optimum the life of the developer material will be incrementally extended but in time falls below the aforementioned useful latitude window for developer chargability. However, if a naturally long life developer material is employed and the proper dispensing rate of carrier granules selected, the charging ability of the developer material will remain within the latitude window for at least the life of the electrophotographic printing machine and there will no longer be a need to change the developer material at some periodic schedule. In the situation where a developer fails or when an electrostatographic printing machine is new, a new developer package is preferably installed. When the electrostatographic printing machine is in a use critical environment, that is, where the machine is, for example, operating in a continuous and or high volume imaging rate, down time or a non-operating condition is preferably avoided or minimized. The present invention provides processes which enable the set up of a fresh developer package in a new or existing machine wherein the set up time is minimized. Further, the present invention provides developers having stable triboelectric charging values, desirable development properties for substantially unlimited imaging cycles, and excellent triboelectric charging properties for substantially longer periods of time, thereby increasing the developer life of the developer compositions and decreasing the time intervals between replacement of the developer materials.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branched chain aliphatic hydrocarbon atoms, and wherein A represents an anionic function including a variety of conventional anionic moieties such as halides, phosphates, acetates, nitrates, benzoates, methylsulfates, perchlorates, tetrafluoroborate, benzene sulfonate, and the like; U.S. Pat. No. 4,221,856 which discloses electrophotographic toners containing resin compatible quaternary ammonium compounds in which at least two R radicals are hydrocarbons having for 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide; a similar teaching is presented in U.S. Pat. No. 4,312,933 which is a division of U.S. Pat. No. 4,291,112 wherein A is an anion including, for example, sulfate, sulfonate, nitrate, borate, chlorate, and the halogens.

Disclosed in U.S. Pat. No. 4,298,672 are positively charged toner compositions with resin particles and pigment particles, and as charge enhancing additives alkyl pyridinium compound. Other documents disclosing positively charged toner compositions with charge control additives include U.S. Pat. Nos. 3,944,493; 4,007,293; 4,079,014; 4,394,430; and 4,560,635, which illustrates a toner with a distearyl dimethyl ammonium methyl sulfate charge additive. U.S. Pat. No. 4,904,762 illustrates toner compositions including a mixture of distearyl dimethyl ammonium sulfate salts (DDAMS/DDABS) as charge enhancing additives. The disclosures of these patents are incorporated herein by reference in their entirety.

In electrostatographic and electrophotographic processes of the prior art, various significant problems exist, for example difficulties in predicting or controlling the developer and toner chargeability.

Further, developers and development processes of the prior art, in particular two component processes, are prone to premature aging leading to degradation in toner charging properties and ultimately the print or copy quality of printed images.

Moreover, photoreceptor scumming phenomena on the photoconductive member may result in compromised copy quality, developer viability and longevity.

Other disadvantages associated with the prior art methods for controlling developer chargeability include having to provide costly or elaborate developer addition means, conditioning means, or separation means, reference for example the aforementioned U.S. Pat. No. 4,614,165.

These and other disadvantages are avoided, or minimized with the development processes and developer compositions of the present invention.

Thus, there remains a need for simple and effective processes for controlling the chargability and the rate of change of developer chargability of developer composition and imaging processes.

There also remains a need for processes which enable a reduction or minimization in the so called "set up" time that is required for developer material when freshly introduced to a developer housing in an electrostatographic imaging apparatus to obtain the chargability and charge stability properties to render the developer and imaging system capable of producing high quality images over an extended number of impression.

The developer compositions and processes of the present invention are useful in many applications, for example, light lens or digital electrophotography.

Practitioners in the art have long sought an inexpensive, efficient and environmentally efficacious means for controlling $A_t$ transience behavior in electrostatographic imaging processes and compositions.

Solutions to the above problems and needs have been unexpectedly found with the compositions and processes of the present invention as illustrated herein.

SUMMARY OF THE INVENTION

Examples of objects of the present invention, in embodiments, include:

to provide development processes and developer compositions that overcome many of the problems and disadvantages of the prior art;

to provide development processes which control or substantially maintain developer chargability properties constant or substantially uniform for an extended number of developed or imaged copies, prints or impressions;

to provide development processes which do not require repeated, extended, or unnecessary service calls and developer modification or maintenance as a means of controlling the developer chargeability; and to provide developers with set up properties or set up times of less than about 2 to about 20 minutes.

Developers used in accordance with the present process invention require substantially less time and substantially fewer copies to produce high quality printed copies after introduction into a printing or copying apparatus.

The use of a spall resistant fluoropolymer coated carrier and eliminating the source and generation of substantially all fine particles, that is, debris, during preparation of the developer according to processes of this invention provides more robust imaging processes and enables higher copy quality of the printed copies than would occur in the presence of such fine particles. In addition, the method for making developer compositions according to the present invention provides developers having stable triboelectric charging values, desirable development properties for substantially unlimited imaging cycles, and excellent triboelectric charging properties for substantially longer periods of time, thereby increasing the developer life of the developer compositions and decreasing the time intervals between replacement of the developer materials.

In embodiments, the present invention overcomes many of the problems and disadvantages of the aforementioned related art processes by providing a robust developer composition when an electrophotographic printing machine is being "set up", for example, when a developer system is charged with a developer in a new or previously unused printing machine, when a printing machine which has been reconditioned for reuse, or when a printing machine which has been modified by the introduction of new or improved development system componentry as illustrated herein.

The present invention provides, in embodiments, a process for controlling developer chargability or $A_t$ transience in electrostatographic imaging processes and compositions.

Other objects and advantages of this invention will be apparent to those skilled in the art in light of the present disclosure and appended claims.

DETAILED DESCRIPTION OF THE INVENTION

Developers and the development stabilization processes in accordance with the present invention require substantially less time, for example less than about 15 to 20 minutes, and substantially fewer copies, for example, less than about 1,000 impressions, and in preferred embodiments, less than about 100 to 200 impressions over about a 1 to about a 2 minute time interval, to accomplish developer set up, that is, after initial introduction of fresh developer into an electrostatographic printing apparatus, preferably in high speed print per minute machines, and thereafter produce high quality printed copies.

The present invention provides, in embodiments, a process for controlling $A_t$ transience phenomena, that is, preventing or minimizing $A_t$ changes or excursions, also known as $A_t$ transients, in electrostatographic and especially xerographic imaging and printing processes, apparatus and compositions. The $A_t$ transience controlling process comprises:

providing a two component developer composition comprising toner particles comprised of a resin, a pigment, a mixture of at least two charge additives, and unpreconditioned coated carrier core particles, wherein the developer is prepared by combining and thereafter blending a mixture of from 1 to about 10 parts by weight of toner particles with about 100 parts by weight of carrier particles for an effective time, of for example, from about 10 minutes to about 30 minutes until an $A_t$ value of from about 60 to about 100 is attained; and forming and thereafter developing electrostatographic latent images on a photoconductive member in a two component development electrostatographic imaging apparatus with the developer composition; wherein the developer composition has an $A_t$ transient of less than about 20, and more specifically, wherein $A_t$ is from about 5 to about 15 relative units over a continuous printing cycle from about 800,000 to about 1,000,000 impressions. Thus, in embodiments of the present invention, the process eliminates the need for preconditioning the coated carrier core particles with toner fines prior to use or reuse of the carrier particles in a xerographic imaging process, and wherein the elimination of the preconditioning step is believed to substantially eliminate the generation of small particle developer debris originating from the coated carrier particles.

The process can, in embodiments, use known developer components in combination with known electrostatographic two component development apparatuses.

Developers utilized according to the method of this invention require substantially less time, for example, about 20 minutes or less, and substantially fewer copies, for example in embodiments, about 500 to 600 copies, to produce high quality printed copies after initial introduction into a printing apparatus.

The carrier particles used in the present invention preferably can have a diameter of from about 50 to about 250 microns and can be composed of, for example, steel, iron ferrites, such as those disclosed in U.S. Pat. No. 3,914,181, the disclosure of which is totally incorporated herein by reference, and reclaimed ferrites. Other carrier particles not specifically disclosed herein can be selected provided that the objectives of the present invention are achieved.

Carrier particles selected for the present invention may have a semicontinuous or continuous coating thereover. Examples of materials conventionally used for forming the carrier coating include fluoropolymers, terpolymers of styrene acrylate, such as those disclosed in U.S. Pat. Nos. 3,467,634 and 3,526,533, the disclosures of which are totally incorporated by reference herein, siloxanes, polymethyl methacrylates, and the like. In embodiments of the present invention, a particularly preferred carrier coating is polyvinyl fluoride, commercially available as TEDLAR®, from DuPont. Coating weights can vary as indicated herein; generally, however, from about 0.3 to about 2, and preferably from about 0.5 to about 1.5 weight percent. In other embodiments it was found that reduced coating weights were also highly effective, for example, wherein the coating weight is selected from about 0.005 to about 0.10 weight percent based on the weight of the core, and preferably from about 0.025 to about 0.075 weight percent. The thickness of the coating, in embodiments, is from about 1 to about 5 microns, and wherein the carrier has a relative surface area coating coverage of from about 10 to about 25 percent. Other coatings not specifically illustrated herein, and admixtures of TEDLAR® and other related non friable and triboelectrically active or inactive resins can be selected, such as KYNAR® a polyvinylidene fluoride polymer, provided that the objectives of the present invention are achieved.

Particularly preferred carrier particles comprise an unoxidized grit steel core containing thereover a semicontinuous or continuous coating of polyvinyl fluoride. Such carrier particles are available from Hoeganaes and methods for preparing them are described, for example, in U.S. Pat. No. 4,233,387, the disclosure of which is totally incorporated herein by reference.

The toner particles combined with the coated carrier particles of the present invention have an average particle diameter preferably ranging from about 2 to about 10 microns, more preferably ranging from about 3 to about 7 microns, and most preferably about 5 microns.

The amount of toner particles used in combination with the coated carriers will preferably range from about 0.1 to about 1.2 parts by weight, more preferably about 0.15 parts by weight, per 100 parts by weight of carrier particles.

Various suitable known toner compositions can be used including compositions containing resin, colorant, and charge enhancing additives.

Examples of suitable toner resins are disclosed, for example, in U.S. Pat. No. 4,298,672, the disclosure of which is totally incorporated herein by reference. Such resins include styrene polymers, styrene methacrylates, styrene acrylates, and styrene acrylonitriles, as well as styrene butadiene polymers. Preferred toner resins include styrene methacrylate polymers containing, for example, about 65 percent by weight of styrene and about 35 percent by weight n-butyl methacrylate. Other suitable toner resins include polyesters and polyamide resins, including extruded polyesters, reference U.S. Pat. No. 5,376,494, the disclosure of which is totally incorporated herein by reference.

Numerous well known colorants can be incorporated into the toner. Examples of suitable colorants include carbon black, nigrosine dye, and mixtures thereof. The colorant is preferably a pigment that contains carbon black in an amount of from about 1 percent by weight to about 20 percent by weight and preferably from about 5 percent by weight to about 10 percent by weight.

Examples of suitable charge enhancing additives include alkyl pyridinium halides, such as those disclosed in U.S. Pat. No. 4,298,672, the disclosure of which is totally incorporated herein by reference, sulfonates and sulfates, such as those disclosed in U.S. Pat. No. 4,338,390, the disclosure of which is totally incorporated herein by reference, and ammonium sulfates, such as those disclosed in U.S. Pat. No. 4,560,635, the disclosure of which is totally incorporated herein by reference. A particularly preferred charge enhancing additive for the developer useful in the present process is a mixture of charge additives comprised of a major amount, such as greater than 50 weight percent, of dimethyl distearyl ammonium methyl sulfate and a minor amount of cetyl pyridinium chloride, such as less than 50 weight percent of the mixture of charge additives.

The charge enhancing additive mixture is comprised of from 2 to about 10 charge enhancing additive compounds and can be incorporated into the toner composition in various effective amounts. Preferably, the total amount of charge enhancing additive will range from about 0.1 percent by weight to about 20 percent by weight, and more preferably from about 1 percent by weight to about 10 percent by weight. In a preferred embodiment, a mixture of charge enhancing additives dimethyl distearyl ammonium methyl sulfate and the cetyl pyridinium chloride charge additives is selected and the respective compounds are present in a relative ratio of from about 6.0:1.0 to about 1.5:1.0.

In an illustrative embodiment, the toner resin is a styrene acrylate copolymer in an amount of from about 75 to about 98 weight percent, the pigment is carbon black in an amount of from about 2 to about 15 weight percent, and the mixture of at least two charge additives is selected from the group of quaternary ammonium salts consisting of cetyl pyridinium halides, dimethyl distearyl ammonium hydrogen and alkyl sulfates with from 1 to about 20 carbon atoms in the alkyl group, tetraalkyl ammonium salts wherein each alkyl group independently has from 1 to 20 carbon atoms, wherein each charge additive is present in an amount of from about 0.1 to about 2 weight percent, and wherein the weight percent is based on the total weight percent of the toner.

The blending of the coated carrier particles and the toner particles in the developer housing is carried out for a brief time period sufficient to enable the toner particles to equilibrate the developer charge ability to a desired level, for example, the in situ blending of toner and developer is carried out for a period preferably ranging from about 10 to about 30 minutes and more preferably ranging from about 10 to about 15 minutes. The resulting two component electrostatographic developer composition has triboelectric charging values preferably ranging from about 10 to about 40 microcoulombs per gram. The in situ blending is preferably minimized in intensity and duration to avoid spalling and prematurely degrading or aging the developer properties.

Particle analysis of the resulting aforementioned equilibrated developer indicates that particle fines or developer debris are minimal and there is little or no toner impaction on the surface of the carrier particles. Examples of debris include dust, carrier tips, paper debris, and oxide particles. Although not being desired to be limited by theory it is believed that the reduced set up time and the coated carrier particles which provide improved coating to core adhesive character may be responsible, partially or entirely, for the absence or minimization of undesirable debris appearing in the developer.

The resulting developer is then evaluated for, for example, triboelectric charging values, triboelectric stability, charge spectra, admix behavior, conductivity, and toner-detone values. "$A_t$" is equal to triboelectric charge times the quantity [Tc+1], where Tc is the toner concentration. In an exemplary developer set up procedure and in accordance with the objects of the present invention, the $A_t$ value is about 80, the triboelectric charge value is about 27 microcoulombs per gram, and the conductivity value is about $5\times10^{-9}$(ohm-cm-1).

Solid area density (SAD) refers to the density of a test patch obtained on a reproduction, copy, print, or impression, when an original document with a patch density of 0.50 unit or higher is imaged. This SAD of the resulting reproduction is usually evaluated using a standard reference document that has several, approximately two inch square patches of known density.

Spalling, or in the alternative, spauling, flaking, and chunking, are terms of art which collectively refer to the formation of smaller pieces or particulate material, which material is broken away from a main structure, that is, particulate debris arising, for example, from the carrier coating as a consequence of the method of preparation of the coated carrier and developer composition, for example, where high shear or intense, or extended mixing time schemes are employed.

The term "stabilized" as used in the context of a stabilized electrostatic developer compositions and development processes of the present invention refers to maintaining the aforementioned $A_t$ value substantially constant over a large number or electrostatographically produced impressions, for example in embodiments, in excess of 800,000 impressions. The term $A_t$ transience or $\Delta A_t$ refers to the measured difference between $A_t$ at zero time (t=0) or impression count minus $A_t$ at 800,000 impression count. As illustrated herein a $\Delta A_t$ greater than about 20 is undesirable and is generally manifested as easily observable deterioration in print quality. In embodiments of the present invention, the process enables developers to posses robust solid area densities (SAD) and images free from background deposits in excess of about 800,000 impressions.

Although not wanted to be limited by theory, it is believed that the present invention provides a synergism of developer constituents and the development apparatus wherein particularly desirable performance advantages are accomplished, and as illustrated herein.

Toner compositions can be prepared by a number of known methods, such as admixing and heating resin particles obtained with the processes of the present invention such as styrene butadiene or styrene acrylate copolymers, pigment particles such as magnetite, carbon black, or mixtures thereof, and cyan, yellow, magenta, green, brown, red, or mixtures thereof, and preferably from about 0.5 percent to about 5 percent of charge enhancing additives in a toner extrusion device, such as the ZSK53 available from Werner Pfieiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters are determined by a Coulter Counter. Subsequently, the toner compositions can be classified utilizing, for example, a Donaldson Model B classifier for the purpose of removing toner fines, that is for example, toner particles less than about 4 microns volume median diameter.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K. K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion melt blending the toner resin particles, pigment particles or colorants, an optional wax, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The toner and developer compositions may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 25 microns, and more preferably from about 8 to about 12 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute.

Also, the toner compositions prepared from resins of the present invention possess desirable narrow charge distributions, optimal charging triboelectric values, preferably of from 10 to about 40, and more preferably from about 10 to about 35 microcoulombs per gram as determined by the known Faraday Cage methods; and rapid admix charging times or rates as determined in the charge spectrograph of less than about 15 seconds, and more preferably in some embodiments from about 1 to about 14 seconds.

The following Examples are being supplied to further define various species of the present invention, it being noted that these Examples are intended to illustrate and not limit the scope of the present invention. Parts and percentages are by weight unless otherwise indicated.

EXAMPLE I

Preparation of Polyvinyl Fluoride(TEDLAR®) Coated Carrier and Developer

A commercially available Hoeganaes type 3220 carrier core, comprising an unoxidized steel core particles, was mixed with 0.05 weight percent coating weight of polyvinyl fluoride particles, for example TEDLAR® available from DuPont, in a Munson mixer for about 30 minutes at reduced pressure of about 9 mm of mercury. The resulting mixture was then heat treated in a kiln at approximately 380° F. peak bed temperature. The resulting carrier was then mixed with the toner of EXAMPLE III, in a 100:2 weight ratio, respectively, in a blender for about 20 minutes to an $A_t$ of approximately 80. This material was used directly in a developer set up procedure as illustrated in Example II without conditioning the carrier with toner particle fines.

EXAMPLE II

Xerographic Developer Set Up Procedure

The developer of EXAMPLE I was introduced into a Xerox Model 1090 copier in the developer housing and thereafter set-up with the abbreviated set up procedure which is enabled as a result of using the $A_t$ stabilization process of the present invention. The set-up procedure is as follows: a series of test patches are formed from the installed developer and on-board electronic copier diagnostics thereafter measures the solid area density of a developed test patch on the photoreceptor; and test patch development continued until a solid area density value is obtained which matches a predetermined or reference acceptable value. The set up time was completed in less than about 15 minutes and required less than about 500 test impression be made. In exemplary instances, typical set up times were completed in about 2 minutes and required that about 100 to about 200 test impression be made and with the result that the developer exhibited no observable scumming or filming on the photoreceptor at zero time (t=0) of the set-up procedure.

COMPARATIVE EXAMPLE I

Preparation of Copoly(vinylidene fluoride-tetrafluoroethylene) (KYNAR®) Coated Carrier and Developer A Hoeganaes type 3220 carrier core, that is an oxidized steel core particles which particle surface is oxidized with about 0.18 weight percent oxide based on the weight of the carrier particles, was mixed with 0.05 weight percent coating weight of copoly(vinylidene fluoride-tetrafluoroethylene) particles, for example KYNAR® available from Pennwalt Corp., in a Munson mixer for about 30 minutes at partial pressure of about 9 mm of mercury. The resulting mixture was then heat treated in a kiln at approximately 500° F. peak bed temperature. This material was used in a developer set up procedure as illustrated in Comparative Example II after preconditioning the carrier with toner particle fines using about 0.15 weight percent of toner fines of about 3 to about 5 microns for a period of about 20 to about 40 minutes, and thereafter blending with nominal size toner of about 10 micron diameter and about 2.0 weight percent toner concentration(Tc) with respect to the carrier, reference for example, commonly assigned U.S. Pat. No. 4,678,734. The set up time was completed in about 120 minutes and required about from about 5,000 to about 20,000 test impression be made before the $A_t$ value was sufficiently stabilized to a level of about 60. The developer was then used continuously for 2.5 hours during which period the $A_t$ value increased to about 100 units, and at which point the developer was observed to produce considerable scumming on the photoreceptor and concomitant copy quality degradation.

COMPARATIVE EXAMPLE II

Xerographic Developer Set Up Procedure

The developer of COMPARATIVE EXAMPLE I was introduced into a Xerox Model 1090 developer housing and thereafter set-up. The set-up procedure was followed as described in EXAMPLE II with the result that the developer exhibited heavy scumming or filming on the photoreceptor at zero time (t=0) of the set-up procedure. The scumming is comprised of debris including, for example, metal oxide particles arising from spalling of the surface of the carrier core granules, toner surface additives, magnetic iron particles arising from magnetite containing developers, reference Example IV, spalled KYNAR® particles, and toner particles and fines. The debris is believed to be generated during the preparation of the developer, particularly during the extended mixing time. This developer was observed to go through an $A_t$ transition wherein the $A_t$ value was observed, in embodiments, to go from a low value in the range of about 60 to 80 to a high range of about 100 to 120, during an early stage of aging, for example, at from about 0 to about 20,000 copies. During the transition, $A_t$ of the developer was transient and exhibited an excursion wherein $A_t$ went above about 100 to about 105, wherein solid area density (SAD) and or high background deposit failure was observed.

EXAMPLE III

Preparation of Toner Particles

A toner composition was prepared by melt blending or extruding a mixture of 92 weight percent of a styrene n-butyl acrylate copolymer with a relative weight ratio of styrene:acrylate of 65:35, 6 weight percent of REGAL 330® carbon black, 1.5 weight percent of dimethyl distearyl ammonium methyl sulfate charge control additive, and 0.5 weight percent of cetyl pyridinium chloride charge control additive at 120° C., and the melt product was pulverized in a Waring blender and jetted to 8 micron number average sized particles.

EXAMPLE IV

Magnetic Toner Preparation and Evaluation

The polymer resin (74 weight percent of the total mixture) used in Example III may be melt extruded with 10 weight percent of REGAL 330® carbon black and 16 weight percent of MAPICO magnetite at 120° C., and the extrudate pulverized in a Waring blender and jetted to 8 micron number average sized particles. A positively charging magnetic toner may be prepared by surface treating the jetted toner (2 grams) with 0.12 gram of a 1:1 weight ratio of AEROSIL R972® (Degussa) and TP-302 a naphthalene sulfonate and quaternary ammonium salt (Nachem/Hodogaya SI) charge control agent.

Developer compositions may then be prepared by admixing 3.34 parts by weight of the aforementioned toner composition with 96.66 parts by weight of a carrier comprised of an unoxidized steel core with 0.05 weight percent coating weight of TEDLAR® polymer thereover; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations may be carried out with a Xerox Corporation 5028® soft silicone roll fuser, operated at 7.62 cm (3 inches) per second.

The actual fuser roll temperatures may be determined using an Omega pyrometer and was checked with wax paper indicators. The degree to which a developed toner image adhered to paper after fusing is evaluated using a Scotch® tape test. The fix level is expected to be excellent and typically greater than 95 percent of the toner image remains fixed to the copy sheet after removing a tape strip as determined by a densitometer. Alternatively, the fixed level may be quantitated using the known crease test, reference U.S. Pat. No. 5,312,704.

Images may be developed in a xerographic imaging test fixture with a negatively charged layered imaging member comprised of a supporting substrate of aluminum, a photogenerating layer of trigonal selenium, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for developer compositions from, for example, Example III are expected to be of excellent quality with no background deposits and of high resolution over an extended number of imaging cycles exceeding, it is believed, about 800,000 imaging cycles wherein the $A_r$ is maintained in the range of from about 50 to about 100 and preferably from about 70 to about 90.

Thus, the process of the present invention provides developer compositions with improved machine performance, developer life and stability without compromising the triboelectric charge properties of the developer.

The aforementioned patents and publications are incorporated by reference herein in their entirety.

Other modifications of the present invention may occur to those skilled in the art based upon a review of the present application and these modifications, including equivalents thereof, are intended to be included within the scope of the present invention.

What is claimed is:

1. A process for controlling $A_r$ transience comprising:

providing in a developer housing, a two component developer composition comprising toner particles comprised of a resin, a pigment, a mixture of at least two charge additives, and unpreconditioned coated carrier core particles, wherein the developer is prepared by combining and thereafter blending a mixture of from 1 to about 10 parts by weight of toner particles with from about 100 parts by weight of carrier particles for about 10 minutes to about 30 minutes until an $A_r$ value of from about 60 to about 100 is attained; and forming and thereafter developing electrostatographic latent images on a photoconductive member in a two component development electrostatographic imaging apparatus with the developer composition; wherein the developer composition has an $A_r$ transient of less than about 20 relative units.

2. A process in accordance with claim 1 wherein the developer exhibits solid area density robustness in excess of about 800,000 impressions.

3. A process in accordance with claim 1 wherein the developed images are free from background deposits for in excess of about 800,000 impressions.

4. A process in accordance with claim 1 wherein the developer housing resides in an electrostatographic apparatus and has a set up time of from about 2 minutes to about 20 minutes.

5. A process in accordance with claim 1 wherein the developer housing resides in an electrostatographic apparatus and has a set up time of less than about 15 minutes.

6. A process in accordance with claim 1 wherein the developer is free from an $A_r$ shortfall of in excess of about 800,000 impressions.

7. A process in accordance with claim 1 wherein the photoconductive member is free of developer scumming phenomena for from about 500,000 to about 800,000 impressions.

8. A process in accordance with claim 1 wherein the coated carrier particles are comprised of an unoxidized steel core and a polyvinyl fluoride coating thereover.

9. A process in accordance with claim 8 wherein elimination of a preconditioning step of the carrier with toner particles substantially eliminates spalling or flaking of the polyvinyl fluoride coating from the surface of the carrier core particles and thereby extends developer life and developer charge ability stability.

10. A process in accordance with claim 1 wherein the toner resin is a styrene acrylate copolymer present in an amount of from about 75 to about 98 weight percent, the pigment is carbon black present in an amount of from about 2 to about 15 weight percent, and the mixture of at least two charge additives is selected from the group of quaternary ammonium salts consisting of cetyl pyridinium halides, dimethyl distearyl ammonium hydrogen and alkyl sulfates with from 1 to about 20 carbon atoms in the alkyl group, tetraalkyl ammonium salts wherein each alkyl group independently has from 1 to 20 carbon atoms, wherein each charge additive is present in an amount of from about 0.1 to about 2 weight percent, and wherein said weight percent is based on the total weight percent of the toner.

11. A process in accordance with claim 10 wherein the mixture of charge additives is comprised of a major amount of dimethyl distearyl ammonium methyl sulfate and a minor amount of cetyl pyridinium chloride.

12. A process in accordance with claim 11 wherein the dimethyl distearyl ammonium methyl sulfate and the cetyl pyridinium chloride charge additives are present in a relative ratio of from about 6.0:1.0 to about 1.5:1.0.

13. A process in accordance with claim 1 wherein the process eliminates the need for preconditioning the coated carrier core particles with toner fines prior to use or reuse of the carrier particles in a xerographic imaging process.

14. A process in accordance with claim 13 wherein the elimination of the preconditioning step substantially eliminates the generation of small particle developer debris originating from the coated carrier particles.

15. A process in accordance with claim 8 wherein the polyvinyl fluoride coating is present in an amount of from about 0.005 to about 0.10 weight percent based on the weight of the core, wherein the thickness of the coating is from about 1 to about 5 microns, and wherein the carrier has a relative surface area coating coverage of from about 10 to about 25 percent.

16. A process in accordance with claim 1 wherein the coated carrier particles possess improved coating to core adhesive character and wherein carrier coating degradation and spalling are substantially reduced.

17. A process in accordance with claim 1 wherein the process is useful for controlling $A_r$ transience in electrostatographic imaging processes and compositions and wherein the process is accomplished in an electrostatographic printing machine.

18. A process in accordance with claim 1 wherein the process and developer charge ability stabilization thereof is accomplished over a continuous printing cycle from about 500,000 to about 1,000,000 impressions.

19. A process for maintaining two component developer triboelectric chargability over time comprising:

providing a two component developer composition comprising toner particles comprised of a styrene-acrylate copolymer, a pigment, and a mixture of two quaternary ammonium salt charge additives, and unoxidized steel carrier core particles with a polyvinyl fluoride coating thereover; and forming and thereafter developing electrostatographic latent images on a photoconductive member in a two component development electrostatographic imaging apparatus with the developer composition;

wherein the developer has an $A_t$ transient value of less than about 20 relative units over about 800,000 impressions, wherein the electrostatographic apparatus has a set up time of less than about 15 minutes, and wherein the photoconductive member is free of developer scumming or filming phenomena over the life of the developer.

20. A process in accordance with claim 19 wherein the photoconductive member is free of developer scumming or filming phenomena from a time zero (t=0) to about 800,000 impressions.

* * * * *